US006302087B1

(12) United States Patent
Schraudner et al.

(10) Patent No.: US 6,302,087 B1
(45) Date of Patent: Oct. 16, 2001

(54) FUEL INJECTION VALVE FOR INTERNAL COMBUSTION ENGINES

(75) Inventors: Kurt Schraudner, Bamberg (DE); Josef Ernst, Linz (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/381,380

(22) PCT Filed: Nov. 17, 1998

(86) PCT No.: PCT/DE98/03387

§ 371 Date: Sep. 20, 1999

§ 102(e) Date: Sep. 20, 1999

(87) PCT Pub. No.: WO99/37909

PCT Pub. Date: Jul. 29, 1999

(30) Foreign Application Priority Data

Jan. 22, 1998 (DE) ..... 198 02 244

(51) Int. Cl.[7] ..... F02M 41/00
(52) U.S. Cl. ..... 123/467; 123/468
(58) Field of Search ..... 123/467, 468; 251/129.15, 129.16; 239/124, 533.8, 585.1–585.5

(56) References Cited

U.S. PATENT DOCUMENTS 4,251,051 * 2/1981 Quenneville et al. ..... 251/129
4,516,730 * 5/1985 Fiissner ..... 239/533.8
4,946,106 * 8/1990 Turchi et al. ..... 239/585
5,088,647 * 2/1992 Yoshida et al. ..... 239/96
5,464,156 * 11/1995 Ricco et al. ..... 239/124

* cited by examiner

*Primary Examiner*—Henry C. Yuen
*Assistant Examiner*—Mahmoud Gimie
(74) *Attorney, Agent, or Firm*—Ronald E. Greigg; Edwin E. Greigg

(57) ABSTRACT

A fuel injection valve for internal combustion engines is supplied from a high-pressure fuel reservoir with high-pressure fuel that at the same time also serves to actuate the injection valve needle of the fuel injection valve. The injection valve needle is actuated via a tappet, which defines a control pressure chamber that is supplied with high-pressure fuel via a Z-throttle and can be relieved via an outlet throttle which is controlled by a magnet valve. The control pressure chamber is enclosed in an insert by the tappet guided in a cylindrical bore, and this insert receives not only the cylindrical bore but also a flat armature, a tappet of the flat armature, and a valve member of the magnet valve. The insert is braced on the housing on the injection valve by the magnet valve housing.

10 Claims, 1 Drawing Sheet

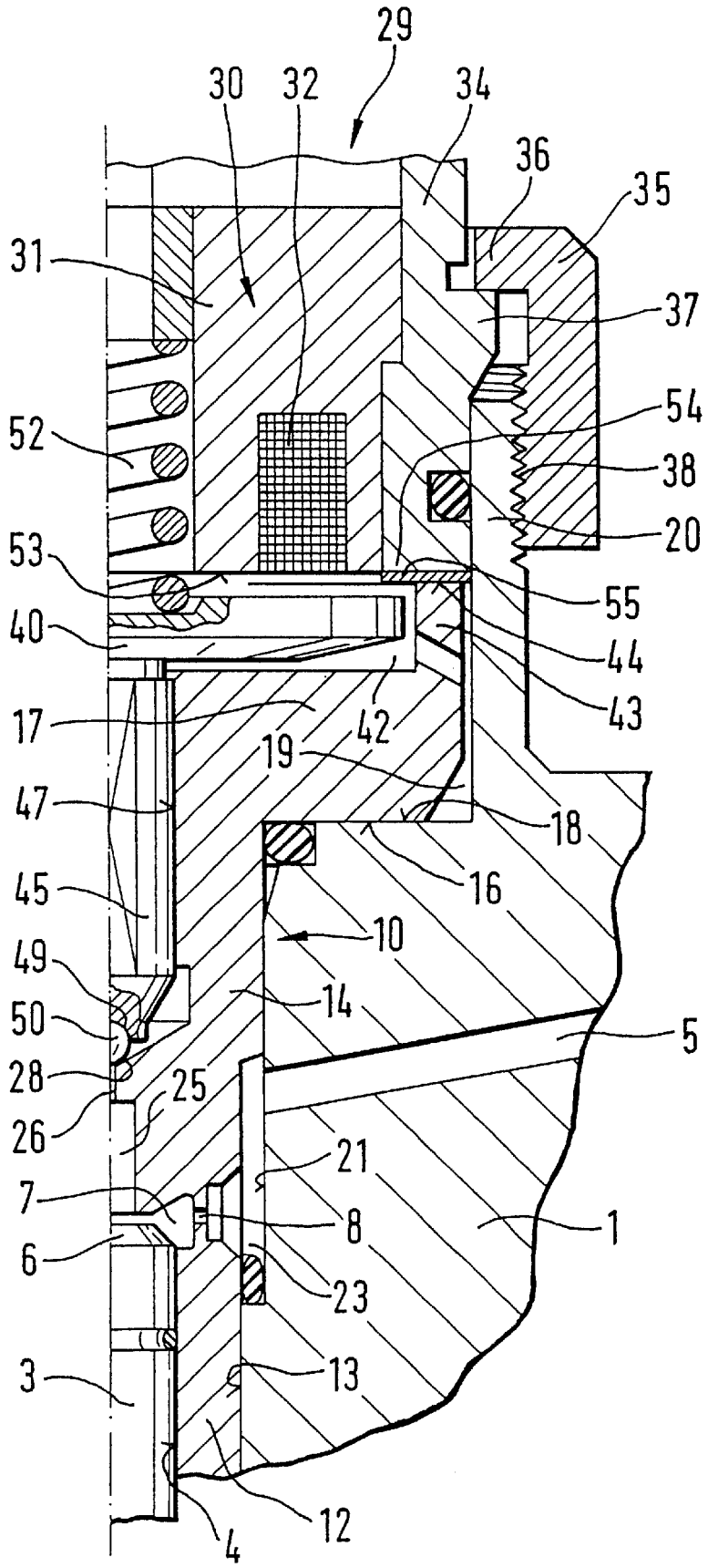
29
30
32
34
36
35
31
37
54
52
38
20
53
55
40
44
43
17
42
19
47
18
16
45
10
49
14
50
5
28
25
26
21
7
8
1
6
23
3
13
12
4

FUEL INJECTION VALVE FOR INTERNAL COMBUSTION ENGINES

PRIOR ART

The invention is based on a fuel injection valve for internal combustion engine. In one such fuel injection valve, known from European Patent Disclosure EP B1 0 304 747, the insert has a peglike part, which is inserted into a suitable blind bore of the housing of the fuel injection valve and with its face end closes a guide bore, inside of the guide bore a tappet is guided that acts on the other end on the injection valve needle. In the known version, the control pressure chamber is accommodated in an axial bore of the insert and communicates, via a throttle, with a further control chamber portion located immediately above the tappet in the guide bore. Between the insert and the tappet, an insert receiving this throttle is provided. The stroke of the tappet can be adjusted by varying the thickness of the insert.

The magnet valve in this version has a magnet valve housing with an axially protruding apron, by way of which the insert is held in its position on the housing of the fuel injection valve. The armature of the magnet valve is guided along the inside circumference of the apron and is located in principal between the upper end of the insert and the core of the electromagnet that actuates the armature. This version entails a major effort to adjust the stroke of the valve member of the magnet valve. It involves the risk that if the armature comes into direct contact with the associated core of the electromagnet, magnetic sticking can disadvantageously occur, which considerably impairs the functioning, and particularly the switching speed of the magnet valve.

ADVANTAGES OF THE INVENTION

By means of the fuel injection valve of the invention as defined hereinafter, a compact design with considerable advantages in terms of production and assembly is attained. Because the insert now receives not only the guide for the valve member of the magnet valve but also the cylinder with the movable wall that encloses the control pressure chamber, a single production unit is created which is easy to make and easy to assemble. It is in particular highly advantageous that the armature is embodied as a flat armature and is adjustable in a cup-shaped recess of the insert, with one rim of the insert protruding past the armature located in the closing position and ending directly in the plane that defines the final stroke position of the armature. Thus, an association of the electromagnet of the magnet valve with the valve seat disposed in the insert can be established in a simple way, and this association can be adjusted exactly by simply reworking the height of the rim of the insert. In a very simple way, it, is then possible by placing a shim between the rim of the insert and the housing or the core of the electromagnet, to define a residual air gap; upon excitation of the electromagnet, the armature moves with its rim into contact with the shim that defines its stroke toward the magnet, specifically in a narrow surface region in the rim region of the outer circumference of the armature. It is thus assured that when the excitation of the electromagnet is turned off, and under the influence of a closing spring, the armature quickly and securely returns the valve closing member to the closing position.

BRIEF DESCRIPTION OF THE DRAWINGS

The sole FIGURE is a cross sectional view of one-half of an injection valve along its longitudinal axis.

DETAILED DESCRIPTION

The drawing shows a part of the fuel injection valve of the invention. An injection valve needle, not identified by reference numeral and of the kind also disclosed in the reference cited at the outset is guided in the housing 1 of the fuel injection valve. This injection valve needle, on one end, has a well known conical sealing face, which cooperates with a likewise conical valve seat in the housing 1, and when the injection valve needle is on its valve seat, it closes injection bores, while when the injection valve needle is lifted it opens the bones. The injection bores can lead directly away from the conical valve seat or from a blind bore adjoining the conical valve seat. Recent injection systems prefer the first option. On the end toward the valve seat, the valve needle surrounds an annular chamber, which extends as far as a pressure chamber on the other end of the annular chamber that communicates constantly with a high-pressure fuel source, not shown, in the form of a high-pressure reservoir. To that end, the housing of the fuel injection valve has an inlet 5. In a conventional version, the tappet 3 is placed on the valve needle and is tightly guided, on an end remote from the valve needle, in a cylindrical bore 4. By way of the length of the part located outside the cylindrical bore, the tappet is positioned spaced apart from the housing, and a compression spring acting in the closing direction is also provided, which engages either the tappet or the injection valve needle.

On a face end 6 forming a movable wall, the tappet 3 encloses a control pressure chamber 7 in the cylindrical bore 4 with the closed end thereof; this chamber communicates with the inlet 5 via an inlet throttle 8, also known as a Z-throttle. To attain this, the cylindrical bore 4 is made inside a cylindrical insert 10, which is made from a part that is stepped on its outer circumference. A part 12 of the smallest diameter in the stepped part is inserted into a housing bore 13 of the housing 1. This smallest part 12 is followed by a part 14 of medium diameter, which is inserted into a correspondingly wider-diameter part of the housing bore 13 and finally changes over, via a shoulder 16, into a flange-like part 17. This part 17 rests with a shoulder on a corresponding shoulder 18 of the housing 1 and is received in a cylindrical recess 19 that is formed by a neck 20 that protrudes from the housing 1. An end region of the smaller-diameter part 12 that adjoins the middle part 14 protrudes into the part of the housing bore 21 that otherwise receives the middle part 14 and with the annular chamber forms an annular chamber 23, into which the inlet 5 discharges. On the other end, the Z-throttle leads away from the annular chamber 23, so that the control pressure chamber 7 can be supplied with fuel via the inlet, the annular chamber 23, and the Z-throttle 8. Seals are also provided above and below this annular chamber 23, to seal the annular chamber off from the outside.

The cylindrical bore 4 is accommodated in the region of the smaller-diameter part 12 of the cylindrical insert. A relief line in the form of a bore 25 leads axially away, inside this part, from the control pressure chamber 7 and changes over to an outlet throttle 26 which in turn ends in a conical valve seat 28 that adjoins a relief chamber. This valve seat is the valve seat of a magnet valve 29, which has an electromagnet 30 with a magnet core 31, a magnet coil 32 embedded in the core, and a magnet valve housing 34 receives the magnet core and coil. The magnet valve housing is screw threaded to the housing of the injection valve by means of a tension nut 35, which is coupled via a collar 36 to the shoulder 37 of the magnet valve housing. The tension nut has a female thread, which is screwed onto a male thread on the neck 20. This operation presses the magnet valve housing against the flange-like part 17 of the cylindrical insert 10, so that the insert comes into solid contact with its shoulder 16 on the shoulder 17 of the housing. And is thus fixed in the housing of the fuel injection valve.

The magnet valve 29 also has a flat armature 40, which comes to rest inside a recess 42 on the face end of the flange-like part 17 of the insert 10. The recess 42 is defined circumferentially by a rim 43, on whose face end 44 the face end of the magnet valve housing acts. Connected to the armature is an axially extending tappet 45, which is part of the valve member and is guided in a guide bore 47 of the insert 10 that is coaxial with the cylindrical bore 4. On the end of the tappet remote from the flat armature 40, the tappet has a receptacle 49 for a ball 50, which cooperates as a valve member with the valve seat 28. The receptacle may be embodied as a separate part, which is displaceable crosswise to the actuation direction of the tappet 45, in order to compensate for errors of alignment resulting from tolerances in production.

The flat armature 40 is also loaded by a compression spring 52, which is accommodated in an axial bore in the interior of the magnet core 31 and is braced there. This spring moves the valve member 50 to the closing position when the electromagnet is not excited. The magnet core 31, toward the flat armature 40, has a flat termination face 53, which is located in the same plane as the face end of the magnet valve housing or protrudes somewhat past it. Thus exact machining of this surface can be done in a simple way. So that the armature, upon excitation of the electromagnet, will not come into direct contact with the termination face of the magnet core 31, a shim 55 which fits over a peripheral region of the flat armature 40 is fastened between the edge 54 of the magnet valve housing 34 and the face end 44 of the rim 43 of the insert 10. Thus when the electromagnet is excited, the flat armature 40 meets only this shim 55 and is not exposed to remanent magnetic forces. This shim may be embodied antimagnetically. If the edge 54 of the magnet valve housing 34 recedes relative to the termination face 53, then the shim 55 can be made correspondingly thicker.

In operation of the fuel injection valve, the control pressure chamber 7 is constantly put at the high pressure, which also prevails in the high-pressure fuel reservoir, via the Z-throttle 8 when the magnet valve is closed. Since the face end 6 of the tappet 3 has a larger surface area than a sealing face acting in the opening direction that is present in a known manner on the injection valve needle, the valve needle is kept in the closing position by the high pressure prevailing in the control pressure chamber. As soon as the magnet valve is excited, the control pressure chamber can be opened to the relief chamber via the bore 25 and the throttle 26. The relief chamber is formed by the entire chamber enclosed by the tappet guide and the recess 42. The relief line communicating with the relief chamber is not identified by reference numeral in the drawing. If the magnet valve closes again because the excitation of the electromagnet is turned off, then the original high-pressure builds up again rapidly in the control pressure chamber 7 via the throttle 8, and the valve needle is then moved into the closing position by the force resulting from this pressure.

The embodiment of the insert with the rim 43 also makes a very favorable adaptation of the geometric dimensions of the valve member to those of the flat armature 40 possible. Advantageously, for exact setting of the dimensions, the ball 50 is replaced by a larger-diameter ball, which puts the flat armature 40 in a position that corresponds to its position when the electromagnet is excited. In this position, the flat armature 40 and the rim 43 of the insert are machined jointly, so that a common plane is created. The stroke of the flat armature 40 can thus be adjusted exactly to the desired dimension. The residual air gap is also set exactly by means of the thickness of the shim 55. The entire arrangement has the advantage that the insert can easily be machined to the required dimensions and is fastened in an equally simple way, together with the housing of the magnet valve, in the housing of the injection valve.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a housing (1) which has an inlet (5) for fuel from a high-pressure fuel supply, an injection valve needle, is guided in the housing, a sealing face disposed on one end of said injection valve needle cooperates with a valve seat in the housing and in so doing controls a connection between a pressure chamber (7) that communicates constantly with the inlet (5) and at least one injection port, and that on another end said injection valve needle is exposed at least indirectly to a pressure in the control pressure chamber (7) that communicates constantly with the inlet (5) via a Z-throttle (8) and is defined a cylinder (4) by a movable wall (6), said movable wall (6) is operatively connected to the injection valve needle, and a relief line (25) containing an outlet throttle (26) leads away from the control pressure chamber (7), and an outlet into a relief chamber is controlled by a magnet valve, a valve member (45, 50) of said magnet valve is connected to an armature (40) and is guided in an insert (10) that receives a valve seat (28) of the magnet valve (29), the relief line (25) and outlet throttle (26) and the control pressure chamber (7), said insert (10) is braced in the housing (1) of the fuel injection valve by the housing (34) of the magnet valve (29), and the insert (10) additionally receives the cylinder (4) with the movable wall (6).

2. The fuel injection valve according to claim 1, in which the armature is embodied as a flat armature (40), which is adjustable inside a cup-shaped recess (42) of the insert (10), by said recess (42) a rim (43) is formed surrounding the flat armature (40), against said rim, a part of the housing (34) of the electromagnet of the magnet valve (29) comes simultaneously into contact, and the rim (43) protrudes past the armature (40) by a length of an armature stroke when the valve member (45, 50) is in the closing position.

3. The fuel injection valve according to claim 2, in which a shim (55) defining a residual air gap, which acts as a stop for an outer circumferential region of the flat armature (40), is fastened between the rim (43) of the insert (10) and the housing (34) of the magnet valve (29).

4. The fuel injection valve according to claim 1, in which the valve member comprises a tappet (45), which is integral with the armature (40) and toward a side of the valve seat (28) has a ball (50) as a sealing element, said ball is guided displaceably transversely to the actuation direction of the tappet (45).

5. The fuel injection valve according to claim 2, in which the valve member comprises a tappet (45), which is integral with the armature (40) and toward a side of the valve seat (28) has a ball (50) as a sealing element, said ball is guided displaceably transversely to the actuation direction of the tappet (45).

6. The fuel injection valve according to claim 3, in which the valve member comprises a tappet (45), which is integral with the armature (40) and toward a side of the valve seat (28) has a ball (50) as a sealing element, said ball is guided displaceably transversely to the actuation direction of the tappet (45).

7. The fuel injection valve according to claim 1 in which the magnet valve (29) is braced on the housing (1) of the fuel injection valve by a tension nut (35) and at a same time, via the housing (34) of the magnet valve (29), the insert (10) is pressed against the housing (1) of the fuel injection valve.

8. The fuel injection valve according to claim 2, in which the magnet valve (29) is braced on the housing (1) of the fuel injection valve by a tension nut (35) and at a same time, via the housing (34) of the magnet valve (29), the insert (10) is pressed against the housing (1) of the fuel injection valve.

9. The fuel injection valve according to claim 3, in which the magnet valve (29) is braced on the housing (1) of the fuel injection valve by a tension nut (35) and at a same time, via the housing (34) of the magnet valve (29), the insert (10) is pressed against the housing (1) of the fuel injection valve.

10. The fuel injection valve according to claim 9, in which the magnet valve (29) is braced on the housing (1) of the fuel injection valve by a tension nut (35) and at a same time, via the housing (34) of the magnet valve (29), the insert (10) is pressed against the housing (1) of the fuel injection valve.

* * * * *